US006615544B1

(12) United States Patent
Tlemcani et al.

(10) Patent No.: US 6,615,544 B1
(45) Date of Patent: Sep. 9, 2003

(54) FIRE-RESISTANT DOOR

(75) Inventors: Jalil Tlemcani, Minneapolis, MN (US); Michael J. Carroll, New Brighton, MN (US); Patrick K. Johnson, Woodbury, MN (US)

(73) Assignee: Nystrom, Inc., Minneapolis, MN (US)

( * ) Notice: Subject to any disclaimer, the term of this patent is extended or adjusted under 35 U.S.C. 154(b) by 0 days.

(21) Appl. No.: 09/598,563

(22) Filed: Jun. 21, 2000

(51) Int. Cl.[7] ..... E05F 15/20

(52) U.S. Cl. ..... 49/7; 52/783.13; 52/232; 52/784.15; 52/784.11; 52/1; 292/DIG. 66; 292/DIG. 65; 292/92; 292/337; 49/8

(58) Field of Search ..... 52/784.11, 1, 783.13, 52/232, 784.15, 92, 337, 784.12; 292/DIG. 66, DIG. 65, 92, 337; 49/4, 7, 8, 360, 379; 428/192, 209, 245, 246, 248, 913, 920, 921, 76

(56) References Cited

U.S. PATENT DOCUMENTS 4,104,828 A * 8/1978 Naslund et al. ..... 49/399
4,191,412 A * 3/1980 LeKander ..... 292/DIG. 66
4,292,358 A 9/1981 Fryer et al.
4,292,538 A 9/1981 Carlson
4,467,562 A * 8/1984 Hemmerling ..... 49/411
4,699,822 A 10/1987 Shu
4,799,349 A 1/1989 Luckanuck
4,811,538 A * 3/1989 Lehnert et al. ..... 52/794
4,888,057 A 12/1989 Nguyen et al.
4,936,064 A 6/1990 Gibb
5,121,950 A * 6/1992 Davidian ..... 292/DIG. 66
5,301,469 A * 4/1994 Lyons, Sr. ..... 49/386
5,305,901 A 4/1994 Dennig
5,373,932 A * 12/1994 Stobich et al. ..... 198/502.1
5,492,208 A * 2/1996 Goossens ..... 292/2
5,501,045 A * 3/1996 Wexler ..... 52/232
5,527,074 A * 6/1996 Yeh ..... 292/177
5,554,433 A 9/1996 Perrone, Jr. et al.
5,565,274 A * 10/1996 Perrone, Jr. et al. ..... 428/457
6,112,488 A * 9/2000 Olson et al. ..... 52/393
6,318,770 B1 * 11/2001 Molzer ..... 292/336.3

OTHER PUBLICATIONS

Bilco Speciality Access Products (BSAP) cat. p. 20.*
Bilco Specialty Access Products catalog, p. 20.
Maxam Metal Products Ltd., Model HD Insulated for Horizontal Floor/Ceiling Applications, Aug. 18, 1998.

* cited by examiner

*Primary Examiner*—Carl D. Friedman
*Assistant Examiner*—Chi Q Nguyen
(74) *Attorney, Agent, or Firm*—Patterson, Thuente, Skaar & Christensen, P.A.

(57) ABSTRACT

A fire-resistant, aluminum, cementitious-material-free, insulation-free door adapted to prevent the spread of fire and heat passing therethrough, consists of: a door frame; a door hingedly mounted on the door frame, the door having a bottom wall, a top wall, and side walls, the bottom wall, top wall and side walls enclosing a hollow central core not containing substantial amounts of insulating material, the bottom wall having an outside surface, and the top wall having an outside surface; and a layer of intumescent material on the outside surface of the bottom wall. A heat-activated self-closing mechanism allows the weight of the door to close the door in the event of fire, by releasing gas from a supporting gas spring.

27 Claims, 7 Drawing Sheets

FIRE-RESISTANT DOOR

BACKGROUND OF THE INVENTION

The present invention relates to a fire-resistant laminate structure and more particularly to horizontally hinged doors for floors that have a high fire rating and which use an automatic control system to automatically close the door in a fire.

The need for fire resistant structures is self-evident and building codes have been passed by governments to ensure that public safety is protected. Such building codes mandate fire-resistant materials such as panels and mechanisms to prevent the spread of fire. Structures such as floors, ceilings, and doors must have resistance to the path of the fire and many techniques have been used to produce such fire resistance.

Horizontally-hinged doors may be used for access doors, roof scuttles, automatic fire vents, ceiling access doors, etc., to provide access from one location to another location such as through a floor into a space between the floor and ceiling below. Such openings are a safety hazard in the event of fire because they present a path to the spread of the fire. Therefore, most fire codes mandate that such openings be closed with fire-resistant materials. It is also necessary for these doors to be automatically closed in case of fire.

The industry standard uses ASTM E119 to define a maximum temperature rating on the unexposed surface to prevent the effect of a fire on the floor below from causing fire damage to the floor above.

Generally, some sort of insulation is required on fire-resistant doors. To achieve ASTM-E119, earlier doors have used either a thick (usually four inch) layer of insulation comprised of mineral wool or fiber board and air within the door structure, or have coated the door with an intumescent material. As used in the present document, "intumescent material" shall be defined as "a material that, upon exposure to heat or flame, swells or puffs up to a relatively thick cellular foam char which possesses heat-insulative and fire-retardant properties."

A problem with mineral wool-insulated doors is that the insulative property of the mineral wool is such that a thick layer, usually four inches, must be used to pass the ASTME-E119 standard. This requires the door to be at least this thick.

A problem with earlier intumescent materials is that by themselves they do not provide sufficient insulative properties to meet ASTM E-119. An example of a fire door constructed with such material is disclosed in U.S. Pat. No. 5,554,433 (Perrone et.al.), herein incorporated by reference. Perrone requires a layer of cementitious material on the door surface opposite the surface on which the intumescent material is applied. According to Perrone, this cementitious material acts as a thermal barrier and insulator and also serves to dissipate the heat that penetrates the structural material of the door by steam produced from water in the cement. The cementitious material is layered onto the door after it is sold, and greatly increases the weight of the door.

U.S. Pat. No. 4,799,349 (Luckanuck), herein incorporated by reference, discloses a steel fire door with a central core filled with mineral wool. The mineral wool is bonded to the inner surfaces of the steel sheets forming the door by a binder comprising a mixture of alkali metal silicate and a mineral powder that causes the binder to intumesce under high temperature, thus protecting the mineral wool against the heat.

A problem with Luckanuck is that the mineral wool is a fiber sheet that completely fills the hollow core of the door, leaving no space within the hollow core for door hardware. Also, Luckanuck is not disclosed as having an aluminum door. Aluminum softens at about 400° C. and melts at about 600° C. (see U.S. Pat. No. 4,888,507, herein incorporated by reference).

There is a need for a fire-resistant floor door that overcomes the problems discussed above. In particular, there is a need for a fire-resistant floor door that may be constructed of aluminum, with an intumescent coating on the outside surface of the door facing the fire, and with a hollow central core without insulating material that may be used to hold door hardware such as the handle, and without the need for a cementitious layer on the outside surface of the door away from the fire.

There is also a need for an improved self-closing mechanism for a fire-resistant door that is substantially less complex and less expensive to manufacture than that disclosed in Perrone.

SUMMARY OF THE INVENTION

A fire-resistant, aluminum, cementitious-material-free, insulation-free door adapted to prevent the spread of fire and heat passing therethrough, consists of: a door frame; a door hingedly mounted on the door frame, the door having a bottom wall, a top wall, and side walls, the bottom wall, top wall and side walls enclosing a hollow central core not containing substantial amounts of insulating material, the bottom wall having an outside surface, and the top wall having an outside surface; and a layer of intumescent material on the outside surface of the bottom wall.

A principle object and advantage of the present invention is that it does not require any cementitious material on the door to provide heat insulation.

Another principle object and advantage of the present invention is that it does not require substantial amounts of insulation material in the interior of the door.

Another principle object and advantage of the present invention is that much of the door hardware, including a lock, may be mounted in the hollow core of the door. This allows the door to be mounted without reducing the clear opening size.

Another principle object and advantage of the present invention is the unique intumescent material used, which provides sufficient insulation, when activated by fire, that cementitious material and additional insulation are not needed.

Another principle object and advantage of the present invention is that the intumescent material shields the door sufficiently that the door may be constructed of aluminum.

Another principle object and advantage of the present invention is that the door passes ASTM E119 for a minimum of two hours.

Another principle object and advantage of the present invention is the novel self-closing mechanism disclosed herein. The self-closing mechanism simply allows the weight of the door to close the door by deflating a gas spring holding the door open, which is a much simpler design than earlier self-closing mechanisms which used a heavy-duty hydraulic system to pull the door shut against the force of compression springs holding the door open.

Another principle object and advantage of the present invention is a reduction in manufacturing cost attributable to the improved design.

DETAILED DESCRIPTION OF THE PREFERRED EMBODIMENTS

Figure 1:
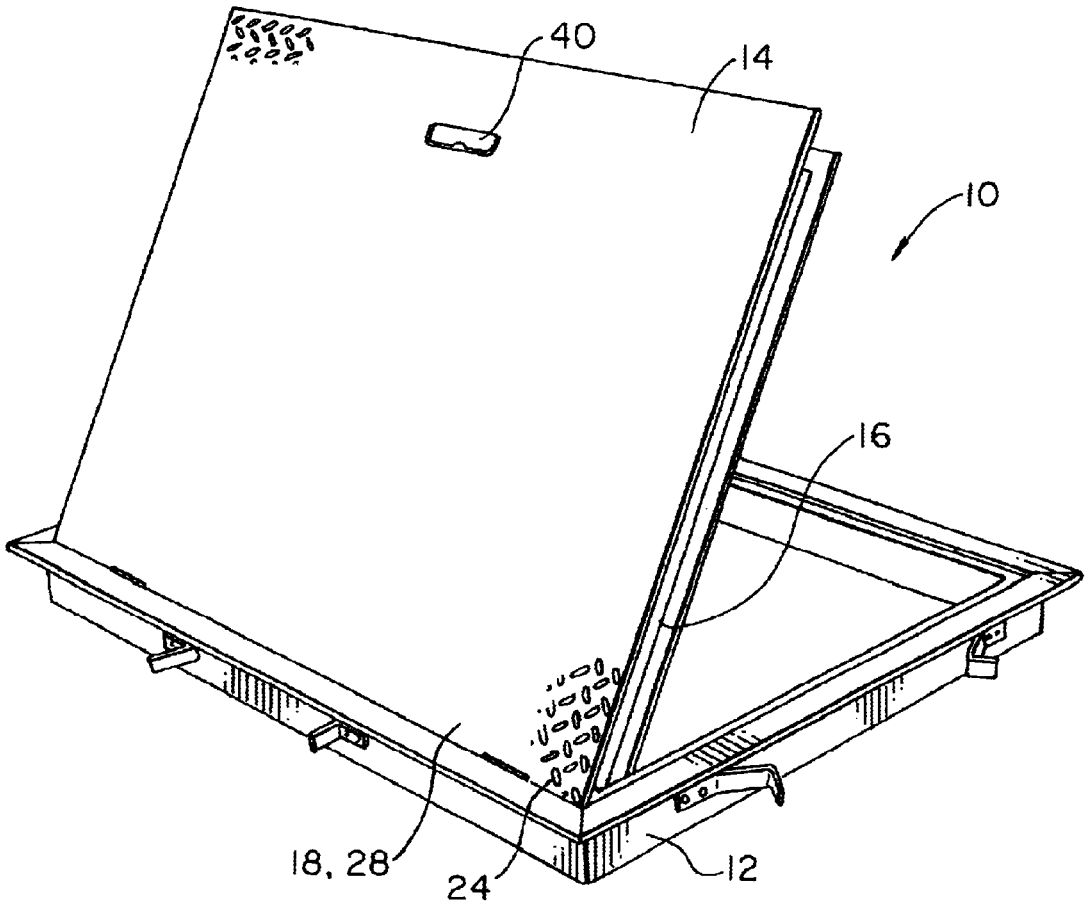
FIG. 1 is a rear perspective view of the door of the present invention.
Figure 2:
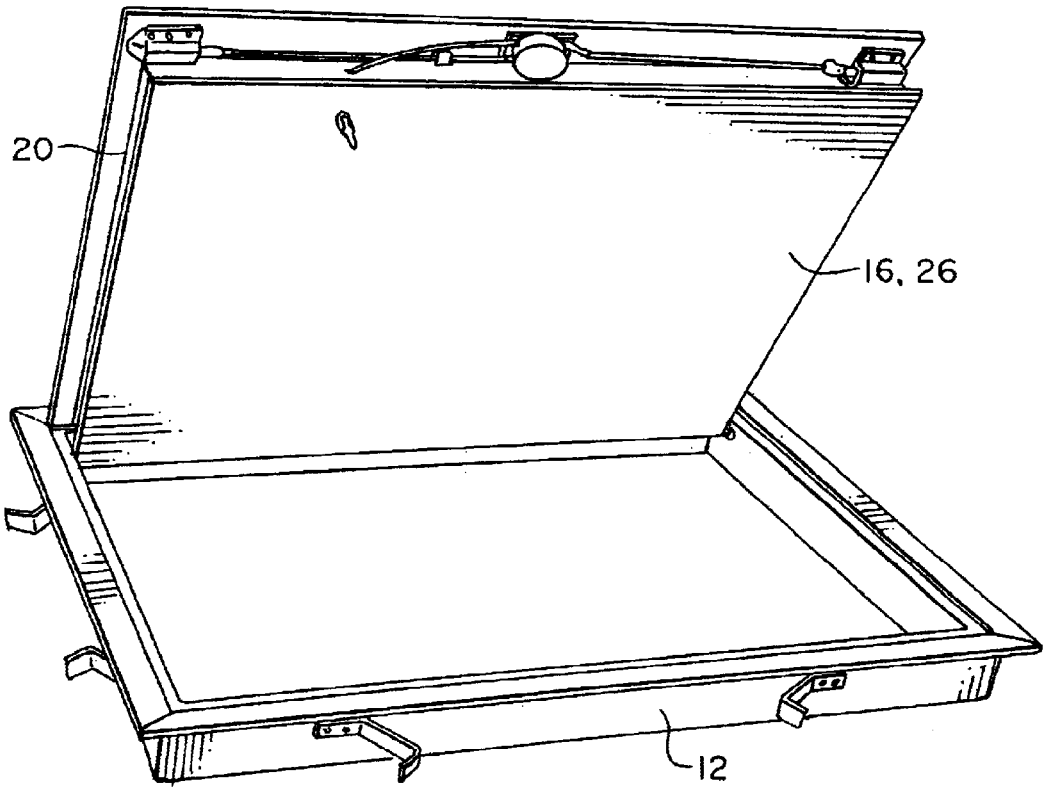
FIG. 2 is a front perspective view of the door of the present invention.

The fire-resistant door of the present invention is generally shown in the Figures as reference numeral 10.

The door 10 comprises a door frame 12, a door 14 hingedly mounted on the frame 12, the door having a bottom wall 16, top wall 18, and side walls 20.

The bottom wall 16, top wall 18, and side walls 20 enclose a hollow central core 22.

The door 14 is hingedly connected to the frame 12 by hinges 24.

The bottom wall 16 has an outside surface 26 and the top wall 18 has an outside surface 28.

A layer of intumescent material 30 is applied to the outside surface 26 of the bottom wall 16. The frame 12 also has a bottom wall 13 to which intumescent material 30 may be applied.

Preferably, the top wall 18, bottom wall 16, and side walls 20 comprise aluminum material.

The door frame 12 has a flange 32 adapted to engage the door when closed. A fiberglass gasket 34 is attached to the flange to provide an insulating seal between the door 14 and the flange 32.

Figure 5:
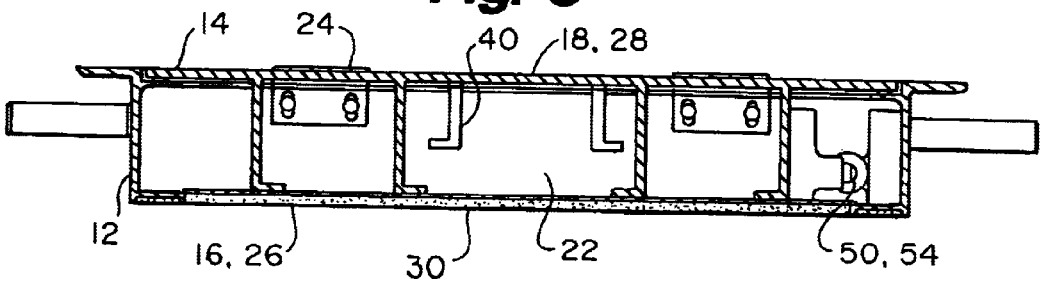
FIG. 5 is a cross-section at about the lines 5 of FIG. 4.
Figure 6:
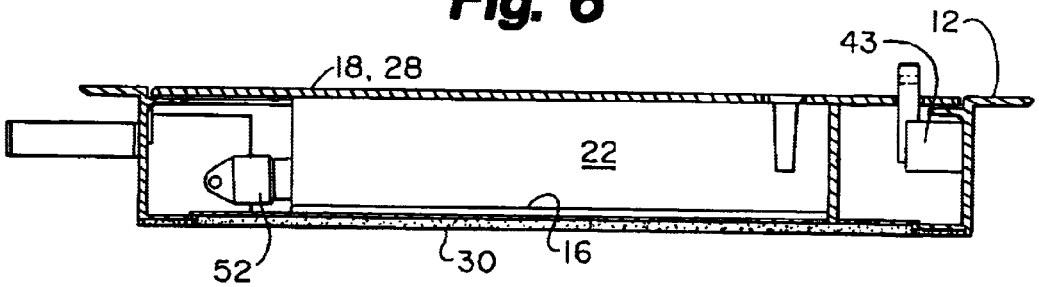
FIG. 6 is a cross-section at about the lines 6 of FIG. 4.
Figure 7:
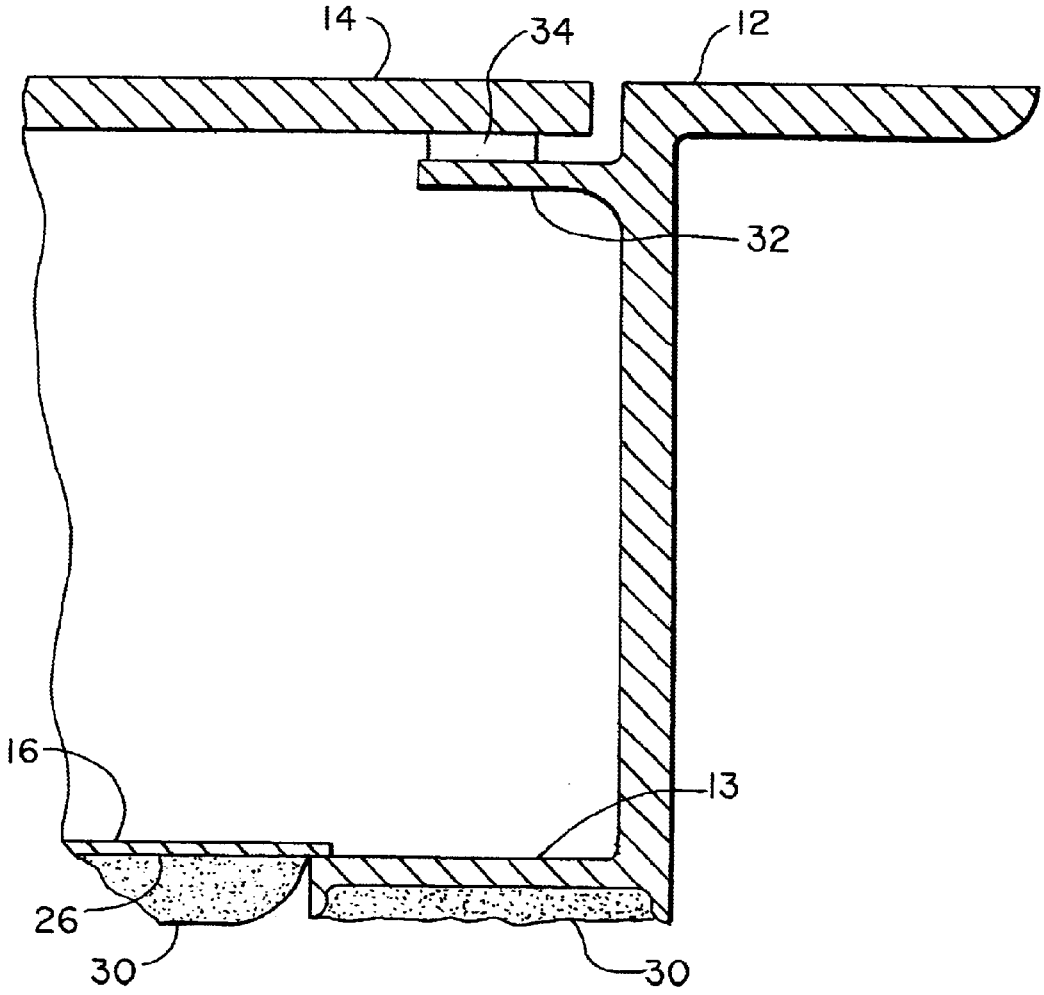
FIG. 7 is a detailed view of the mating area of the door and frame circled in FIG. 6 without the padlock hasp.

The door 10 also has a handle 40 and the top wall 18 has a handle receiving slot 42 therethrough, wherein the handle 40 is adapted to slide through the handle receiving slot 42 into the hollow central core 22, as best seen in FIG. 5. A lock 43 may also be included in the hollow central core 22 as shown in FIG. 6.

The door 10 further comprises a heat-activated self-closing mechanism 50 at least partially mounted within the hollow core 22.

Figure 3:
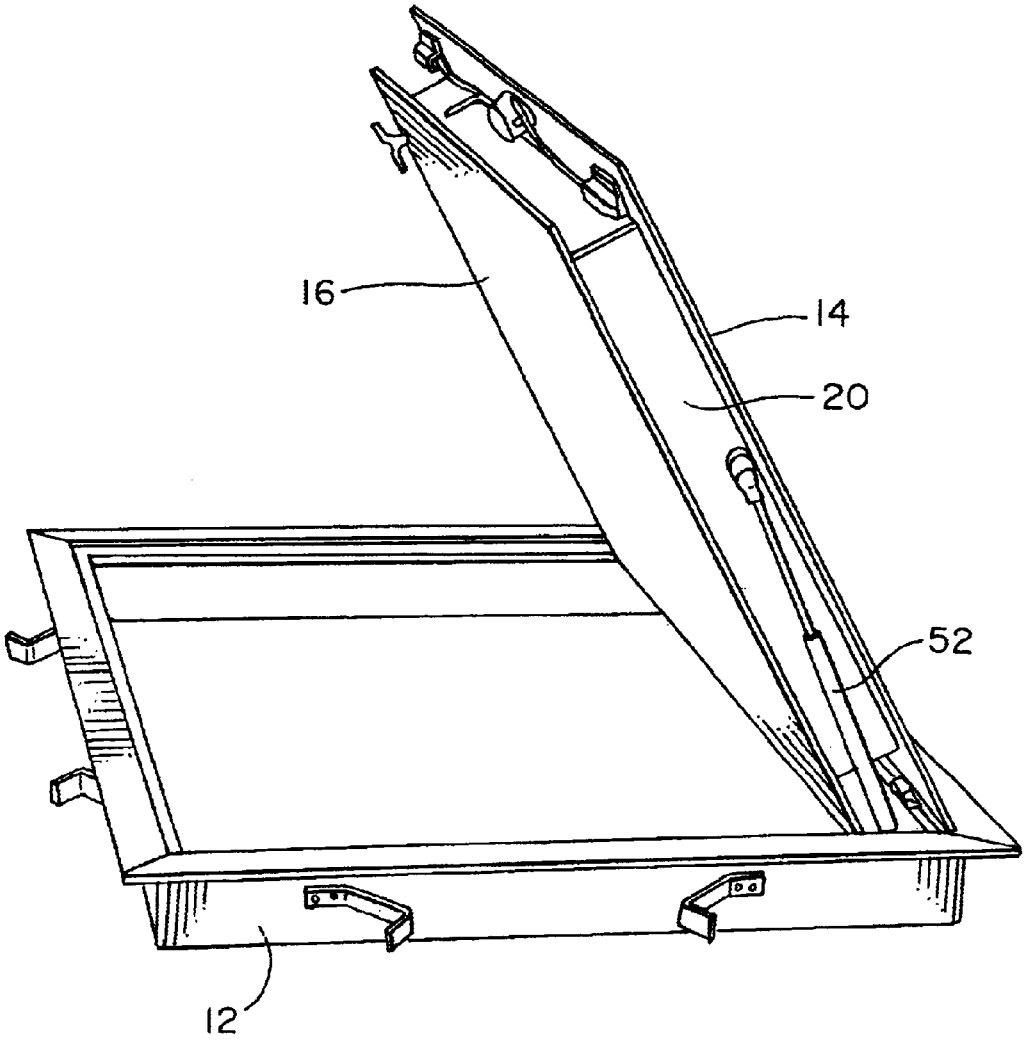
FIG. 3 is a right side perspective view of the door of the present invention.
Figure 4:
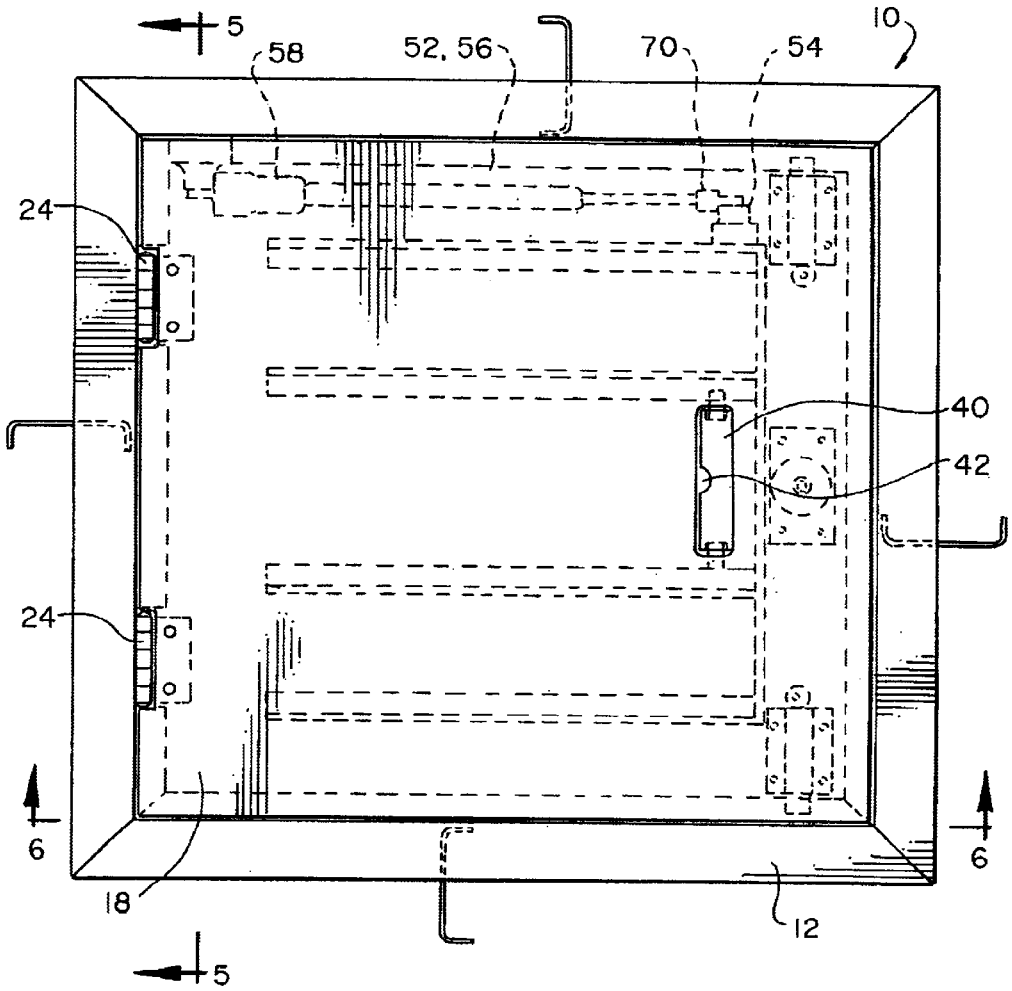
FIG. 4 is a top plan view of the door of the present invention with internal structure shown in phantom.

As best seen in FIG. 3, the self-closing mechanism further comprises a collapsible supporting member 52 adapted to hold the door 14 spaced from the frame 12 in an open position.

The self-closing mechanism 50 also comprises a trigger mechanism 54 mounted within the hollow core 22 that interacts with the collapsible supporting member 52 to collapse the collapsible supporting member 52 in the event of a fire.

Preferably, the collapsible supporting member 52 comprises a gas spring 56 having a pressurized cylinder core 58 and a pressure-release valve 70. The trigger mechanism 54 cooperates with the pressure-release valve 70 to release pressure from the pressurized cylinder core 58, thereby causing the collapsible supporting member 52 to collapse.

Figure 10:
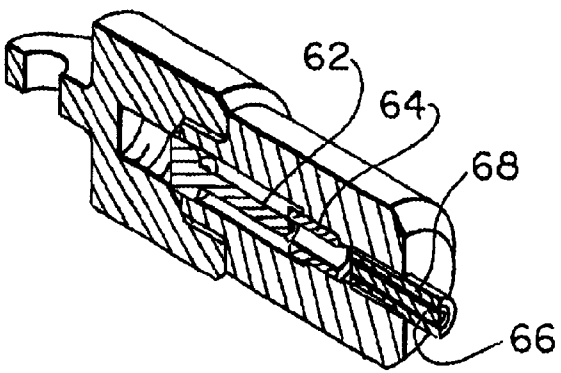
FIG. 10 is a perspective view of the trigger assembly, with some structure cut away.
Figure 9:
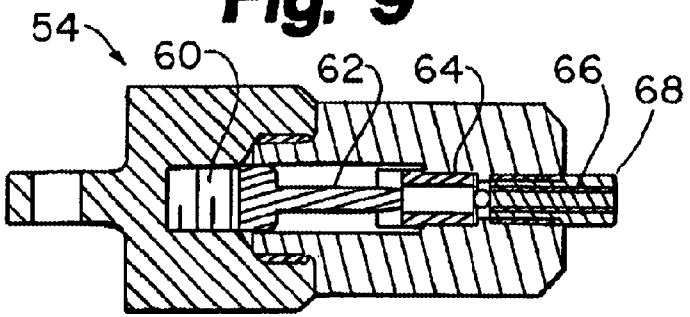
FIG. 9 is a detailed cross section of the trigger assembly.

Details of the trigger mechanism 54 are shown in FIGS. 9 and 10.

The trigger mechanism 54 further comprises a compression spring 60, a firing pin 62, a fusible link plug 64, a slave pin 66 spaced from the firing pin 62 by the fusible link plug 64, and a threaded hollow stud 68 adapted to be connected to the pressure-release valve 70. The compression spring 60 biases the firing pin 62 toward the slave pin 66. The fusible link has a melting core that melts in the event of a fire, allowing the compression spring to drive the firing pin 62 against the slave pin 66, with the slave pin 66 then moving within the threaded hollow stud 68 to engage the pressure-release valve 70, thereby bleeding gas out of the pressurized cylinder core 58.

Operation of the self-closing mechanism is as follows. The standard gas spring 56 contains the pressure-release valve 70 on the end of its pressurized cylinder core 58. This valve 70 is identical to one used in any tire application. The trigger mechanism relies on the spring-compressed firing pin 62 acting as a plunger to deflate the gas spring 56. This compressed spring 60 is placed inside an aluminum enclosure on one side of the firing pin 62. Inside the enclosure, on the other side of the firing pin 62, is the fusible link plug 64. This plug normally blocks the pin 62 from moving along the inside of the enclosure. Under fire conditions, the core of this plug melts, making way for the firing pin 62 to move forward to the gas valve. The enclosure is assembled to the gas valve 58 using a common hollow threaded stud 68. The slave pin 66, inserted into the stud 68, is given enough tolerance to move freely. The firing pin 62 will push the slave pin 66, which in turn pushes on the valve 58 to bleed out the pressurized gas within the cylinder. The enclosure containing the firing pins has an end mount that allows the whole spring assembly to act as a counterbalance for the door 14.

The door 10 may also have a two-point latch mechanism 80 securing the door 14 to the frame 12. The mechanism 80 is operable from inside or outside the door. See FIG. 8.

Figure 8:
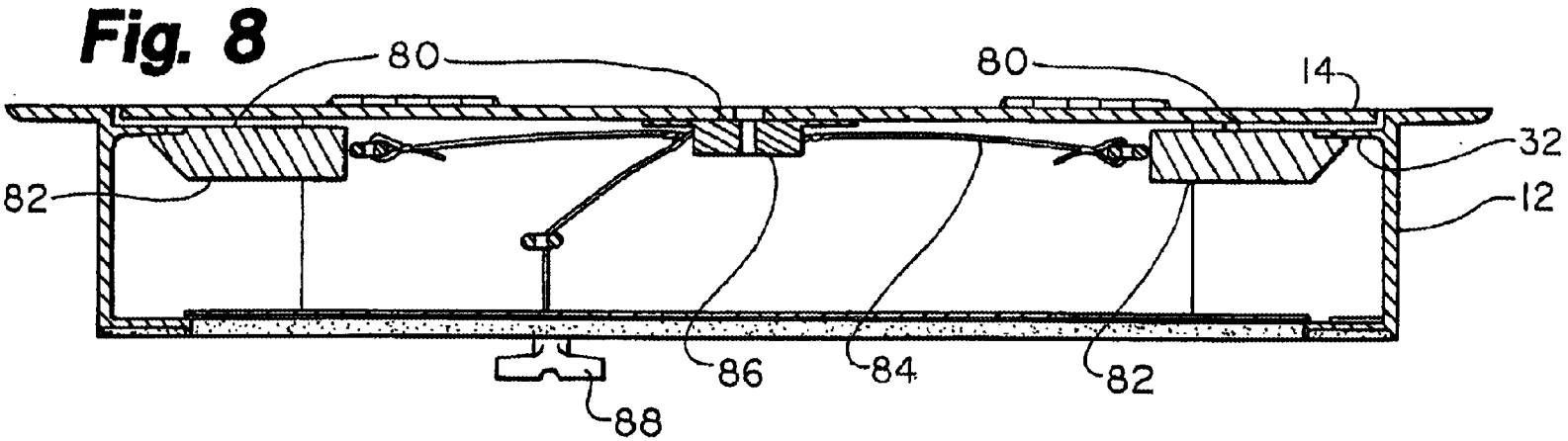
FIG. 8 is a cross-section through the door showing the two-point latching mechanism.

As seen in FIG. 8, the latch mechanism 80 further comprises at least one sliding latch 82 adapted to engage the frame 12, as for example by the flange 32. The latch 82 is biased against the frame 12 by a spring (not shown).

The latch mechanism 80 also comprises a lanyard 84 engaging the latch 82.

A central key member 86 is connected to the lanyard 84. To open the door from the outside, a key is inserted into the key member 86 and turned, causing the lanyard 84 to withdraw the latch 82 from the frame 12. Alternatively, the door may be opened from the inside by pulling on the inside release handle 88, again causing the lanyard 84 to withdraw the latch from the frame.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A fire resistant door designed to prevent the spread of fire and heat passing therethrough, the door comprising:

a door frame;

a door hingedly mounted on the door frame, the door having a bottom wall, a top wall, and side walls, the bottom wall, top wall and side walls enclosing a hollow central core, the bottom wall having an outside surface, and the top wall having an outside surface; and a heat activated self closing mechanism comprising a trigger mechanism, wherein the trigger mechanism is mounted within the hollow core.

2. The fire-resistant door of claim 1, wherein no cementitious material is applied to the outside surface of the top wall.

3. The fire-resistant door of claim 1, wherein the top wall and side walls further comprise aluminum material.

4. The fire-resistant door of claim 1, the door frame having a flange adapted to engage the door when closed, and further comprising a fiberglass gasket attached to the flange.

5. The fire-resistant door of claim 1, further comprising a handle, the top wall having, a handle receiving slot therethrough, wherein the handle is adapted to slide through the handle receiving slot into the hollow central core.

6. The fire resistant door of claim 1, the self-closing mechanism further comprising a collapsible supporting member adapted to hold the door spaced from the frame in an open position.

7. The fire-resistant door of claim 6, wherein the trigger mechanism interacts with the collapsible supporting member to collapse the collapsible supporting member in the event of fire.

8. The fire-resistant door of claim 7, wherein the collapsible supporting member further comprises a gas spring having a pressurized cylinder core and a pressure-release valve.

9. The fire-resistant door of claim 8, wherein the trigger mechanism cooperates with the pressure-release valve to release pressure from the pressurized cylinder core, thereby causing the collapsible supporting member to collapse and allowing the door to close.

10. The fire-resistant door of claim 9, wherein the trigger mechanism further comprises a compression spring, a firing pin, a fusible link plug, a slave pin spaced from the firing pin by the fusible link lug, and a threaded hollow stud adapted to be connected to the pressure-release valve, the compression spring biasing the firing pin toward the slave pin, wherein the fusible link plug further comprises a melting core, and wherein melting of the melting core allows the compression spring to drive the firing pin against the slave pin, the slave pin moving within the threaded hollow stud to engage the pressure-release valve.

11. The fire-resistant door of claim 1, wherein the door frame has a bottom wall and further comprising a layer of intumescent material on the outside surface of the door frame's bottom wall.

12. The fire-resistant door of claim 1, wherein the door is secured to the frame by a two-point latch mechanism operable from inside or outside the door.

13. A fire resistant door designed to prevent the spread of fire and heat passing therethrougth, the door comprising:

a door frame;

a door hingedly mounted on the door frame, the door having a bottom wall, a top wall, and side walls, the bottom wall, top wall and side walls enclosing a hollow central core, the bottom wall having an outside surface, and the top wall having an outside surface; and a heat-activated self closing mechanism comprising a trigger mechanism that interacts with a collapsible supporting member to collapse the collapsible supporting member in the event of a fire, the collapsible supporting member further comprises a gas spring having a pressurized cylinder core and a pressure release valve, wherein the trigger mechanism further comprises a compression spring, a firing pin, a fusible link plug, a slave pin spaced from the firing pin by the fusible link plug, and a threaded hollow stud adapted to be connected to the pressure release valve, the compression spring biasing the firing pin toward the slave pin, wherein the fusible link plug further comprises a melting core, and wherein melting of the melting core allows the compression spring to drive the firing pin against the slave pin, the slave pin moving within the threaded hollow stud to engage the pressure release valve.

14. The fire-resistant door of claim 13, wherein the top wall and side walls further comprise aluminum material.

15. The fire-resistant door of claim 13, wherein the bottom wall further comprises a metallic heat shield.

16. The fire-resistant door of claim 13, the door frame having a flange adapted to engage the door when closed, and further comprising a fiberglass gasket attached to the flange.

17. The fire-resistant door of claim 13, further comprising a handle, the top wall having a handle receiving slot therethrough, wherein the handle is adapted to slide through the handle receiving slot into the hollow central core.

18. The fire-resistant door of claim 13, wherein the self-closing mechanism further comprises a trigger mechanism is mounted within the hollow central core.

19. The fire-resistant door of claim 13, wherein the trigger mechanism cooperates with the pressure-release valve to release pressure from the pressurized cylinder core, thereby causing the collapsible supporting member to collapse.

20. The fire-resistant door of claim 13, wherein the door frame has a bottom wall and further comprising a layer of intumescent material on the outside surface of the door frame's bottom wall.

21. The fire-resistant door of claim 13, wherein the door is secured to the frame by a two-point latch mechanism operable from the inside or outside the door.

22. A heat-activated self-closing mechanism for a horizontal door, the door being held in the open position against gravity, comprising a collapsible supporting member and a trigger mechanism interacting with the collapsible supporting member to the collapsible supporting member in the event of a fire, the collapsible supporting member further comprises a gas spring having a pressurized cylinder core and pressure-release valve, wherein the trigger mechanism further comprises a compression spring, a firing pin, a fusible link plug, a slave pin spaced from the firing pin by the fusible link plug, and a threaded hollow stud adapted to be connected to the pressure release valve, the compression spring biasing the firing pin toward the slave pin, wherein the fusible link plug further comprises a melting core, and wherein melting of the melting core allows the compression spring to drive the firing pin against the slave pin, the slave pin moving within the threaded hollow stud to engage the pressure release valve.

23. The fire-resistant door of claim 22, wherein the trigger mechanism cooperates with the pressure-release valve to release pressure from the pressurized cylinder core, thereby causing the collapsible supporting member to collapse and allowing the door to close.

24. A fire resistant door adapted to fit onto a frame, the door comprising:

a door hingedly mounted on the door frame, the door having a bottom wall, a top wall, and side walls, the bottom wall, top wall and side walls enclosing a hollow central core, the bottom wall having an outside surface, and the top wall having an outside surface; and a heat activated self closing mechanism comprising a trigger mechanism, wherein the trigger mechanism is mounted within the hollow core.

25. The fire resistant door of claim 1, further comprising a layer of intumescent material on the outside surface of the bottom wall.

26. The fire resistant door of claim 14, wherein no cementitious material is applied to the outside surface of the top wall.

27. The fire resistant door of claim 14, further comprising a layer of intumescent material on the outside surface of the bottom wall.

* * * * *

UNITED STATES PATENT AND TRADEMARK OFFICE

CERTIFICATE OF CORRECTION

PATENT NO. : 6,615,544 B1
DATED : September 9, 2003
INVENTOR(S) : Tlemcani et al.

It is certified that error appears in the above-identified patent and that said Letters Patent is hereby corrected as shown below:

Column 1,
Line 45, delete "ASTME" and insert -- ASTM --.
Line 51, delete "et.al." and insert -- et al. --.

Column 5,
Line 18, delete the comma after "having".
Line 41, delete "lug" and insert -- plug --.

Signed and Sealed this

Thirtieth Day of December, 2003

JAMES E. ROGAN
*Director of the United States Patent and Trademark Office*